US009108236B2

(12) United States Patent
Jesche et al.

(10) Patent No.: US 9,108,236 B2
(45) Date of Patent: Aug. 18, 2015

(54) METHOD FOR TRANSFERRING A METAL COIL

(75) Inventors: Michael Jesche, Mödling (AT); Robert Minichmayr, Enns (AT); Wolfgang Peitl, St. Florian (AT); Alois Seilinger, Linz (AT)

(73) Assignee: SIEMENS VAI METALS TECHNOLOGIES GMBH (AT)

( * ) Notice: Subject to any disclaimer, the term of this patent is extended or adjusted under 35 U.S.C. 154(b) by 248 days.

(21) Appl. No.: 13/821,565

(22) PCT Filed: Aug. 29, 2011

(86) PCT No.: PCT/EP2011/064806
§ 371 (c)(1), (2), (4) Date: May 4, 2013

(87) PCT Pub. No.: WO2012/034842
PCT Pub. Date: Mar. 22, 2012

(65) Prior Publication Data
US 2013/0214078 A1 Aug. 22, 2013

(30) Foreign Application Priority Data
Sep. 16, 2010 (EP) ..... 10176982

(51) Int. Cl.
*B65H 19/12* (2006.01)
*B21C 47/24* (2006.01)
(Continued)

(52) U.S. Cl.
CPC ..... *B21C 47/24* (2013.01); *B21C 47/08* (2013.01); *B21C 47/22* (2013.01)

(58) Field of Classification Search
CPC ..... B65H 19/12; B65H 19/30; B65H 2301/41447; B21B 39/008
USPC ..... 242/533.2, 559, 595.1; 72/251, 252.5
See application file for complete search history.

(56) References Cited

U.S. PATENT DOCUMENTS

| | | | | |
|---|---|---|---|---|
| 5,987,955 | A | 11/1999 | Benner | 72/250 |
| 8,281,633 | B2 * | 10/2012 | McKenney et al. | 72/250 |
| 2013/0214078 | A1 | 8/2013 | Jesche et al. | 242/363 |

FOREIGN PATENT DOCUMENTS

| | | | |
|---|---|---|---|
| CN | 1583308 | A | 2/2005 |
| CN | 2732376 | Y | 10/2005 |

(Continued)

OTHER PUBLICATIONS

Korabi, Tarif et al., "New Developments Expand Coilbox Applications," AISE Steel Technology, Iron and Steel Engineer, vol. 32, No. 12, 8 pages, Dec. 1, 1996.

(Continued)

*Primary Examiner* — Sang Kim
(74) *Attorney, Agent, or Firm* — Ostrolenk Faber LLP

(57) ABSTRACT

A method is disclosed for transferring a metal coil, e.g., for transferring a metal coil in a coil box, on a transfer path between a first coil position and a second coil position, wherein the metal coil is supported during the transfer on the transfer path in segments by means of support rollers, and wherein the metal coil is simultaneously unwound, wherein a cradle expanding in the direction of the transfer path is formed by changing the positions of support rollers disposed adjacent to each other, wherein the coil is supported by two support rollers disposed on a first frame part in the first coil position and is displaced in the direction of the second coil position from said first coil position in that said frame part is simultaneously tilted and lowered.

12 Claims, 7 Drawing Sheets

(51) Int. Cl.
*B21C 47/08* (2006.01)
*B21C 47/22* (2006.01)

(56) References Cited

FOREIGN PATENT DOCUMENTS

| | | | | |
|---|---|---|---|---|
| CN | 101157103 A | 4/2008 | | |
| DE | 19803091 A1 | 7/1999 | ..... | B21C 47/24 |
| JP | 10034231 A | 2/1998 | ..... | B21C 47/00 |
| WO | 2009/103144 A1 | 8/2009 | ..... | B21C 47/24 |
| WO | 2012/034842 A1 | 3/2012 | ..... | B21C 47/08 |

OTHER PUBLICATIONS

International Search Report and Written Opinion, Application No. PCT/EP2011/064806, 17 pages, Nov. 14, 2011.

* cited by examiner

METHOD FOR TRANSFERRING A METAL COIL

CROSS-REFERENCE TO RELATED APPLICATIONS

This application is a U.S. National Stage Application of International Application No. PCT/EP2011/064806 filed Aug. 29, 2011, which designates the United States of America, and claims priority to EP Patent Application No. 10176982.6 filed Sep. 16, 2010. The contents of which are hereby incorporated by reference in their entirety.

TECHNICAL FIELD

The disclosure relates to a coil transfer device, e.g., for transferring a metal coil in a coil box.

BACKGROUND

In rolling mill technology, a type of installation is known in which a roughing pre-strip arriving from the roughing train is wound into a coil in what is known as a coil box and is then unwound for further processing and supplied to a finishing train. A coil box is a strip reeling device that first bends the metal strip arriving from the r train by means of rotationally-driven bending rollers, such that it is wound into a metal coil in a winding cradle formed by support rollers. When the metal coil has been fully wound, the end of the strip becomes the strip head in the subsequent finishing and rolling process. As long as the metal coil is in this winding position, the coil box cannot accept any further strips.

In order to guarantee as large as possible a throughput of material, the unwinding process is already started while the metal coil is still in its winding position. Attempts are made to clear this location as quickly as possible so that the next rough strip approaching can be wound. In order to create this space, a change in the position of the coil is required in the coil box, that is, from the winding position into an unwinding position located in the direction of the finishing train.

Since, by virtue of its temperature, the metal coil in the coil box is easily deformable, the transfer should be done as gently as possible since damage can otherwise occur to the outer layer of the metal coil if the coil is subjected to a hard impact against an abutment, for example.

Document DE 198 03 091 A1 discloses an operating method for a coil transfer device wherein support rollers of a winding and unwinding station are each disposed on moveable frame components that can be moved towards each other and tilted.

In the process, the metal coil, which usually weighs from around 10 to 40 t and is at a relatively high temperature of from around 900° C. to 1100° C., can sustain damage on its outer winding. Part of the outer perimeter then has to be scrapped.

SUMMARY

One embodiment provides a method for transferring a metal coil, e.g., of a metal coil in a coil box, on a transfer path between a first coil position and a second coil position, wherein the metal coil is supported during the transfer on the transfer path in segments by means of support rollers, and wherein the metal coil is simultaneously unwound, wherein an unwinding cradle expanding in the direction of the transfer path is formed by changing the positions of support rollers disposed adjacent to each other, wherein the coil is supported by two support rollers disposed on a first frame part in the first coil position and is moved in the direction of the second coil position from said first coil position while said frame part is simultaneously tilted and lowered.

In a further embodiment, the first frame part is pivoted on a second frame part and the tilting and lowering movement is generated by a pivoting movement of the first frame part round an axis and a simultaneous pivoting movement of the second frame part around a different axis.

In a further embodiment, the metal coil is supported during the transfer in an alternating sequence by two or by three support rollers.

In a further embodiment, the two support rollers disposed on the first frame part are driven by means of a first actuator unit having the same rotational speed.

In a further embodiment, one support roller and a different support roller are each disposed on a swivel arm and are separately rotationally driven by an assigned actuator unit, wherein a velocity element that is derived from the pivoting movement round each assigned axis of the respective support roller is taken into account when setting the rotational speed.

In a further embodiment, the metal coil is supported in the unwinding position by means of an adjustable support roller.

BRIEF DESCRIPTION OF THE DRAWINGS

Exemplary embodiments will be explained in more detail below based on the schematic drawings, wherein.

DETAILED DESCRIPTION

Embodiments of the present disclosure provide a method for transferring a metal coil which allows a careful transfer such that there is little scrap and which is, moreover, reliable.

According to some embodiments, the transfer of the metal coil is carried out on support rollers, the positioning whereof with respect to the transport plane is successively predetermined such that a roller bed recess continuing in the transfer direction is formed. The positioning of the respective support rollers is achieved by means of assigned part-turn actuators, such as, for example, a hydraulic cylinder. A sequence of movements that is similar to a "traveling wave" is generated and this moves the metal coil along with it in a "wave trough". During the transfer procedure, the metal coil is alternately supported by two or by three support rollers. This involves the coil being supported in a first coil position by means of two support rollers disposed on a first frame part. The coil is moved out of this position as said frame part is simultaneously tipped and lowered. This allows a careful transfer to the subsequent roller bed in the transport direction. The active handover between support by two and support by three support rollers can be handled very carefully during this procedure by controlling the actuators accordingly. Thus only comparatively slight forces impact on the outer perimeter of the coil and there is less risk of damage.

A stable position of the metal coil is achieved if the coil is supported by two or by three support rollers during the transfer in an alternating sequence.

In order to avoid damaging the surface of the strip, the peripheral speed of each roller that is in contact with the strip may be equal to the speed of the strip.

Example embodiments are described in more detail hereafter by way of example with the aid of the sequence of a coil transfer procedure that is illustrated in FIGS. 1 to 7. In the figures the same reference signs denote identical or similar components.

Figure 1:
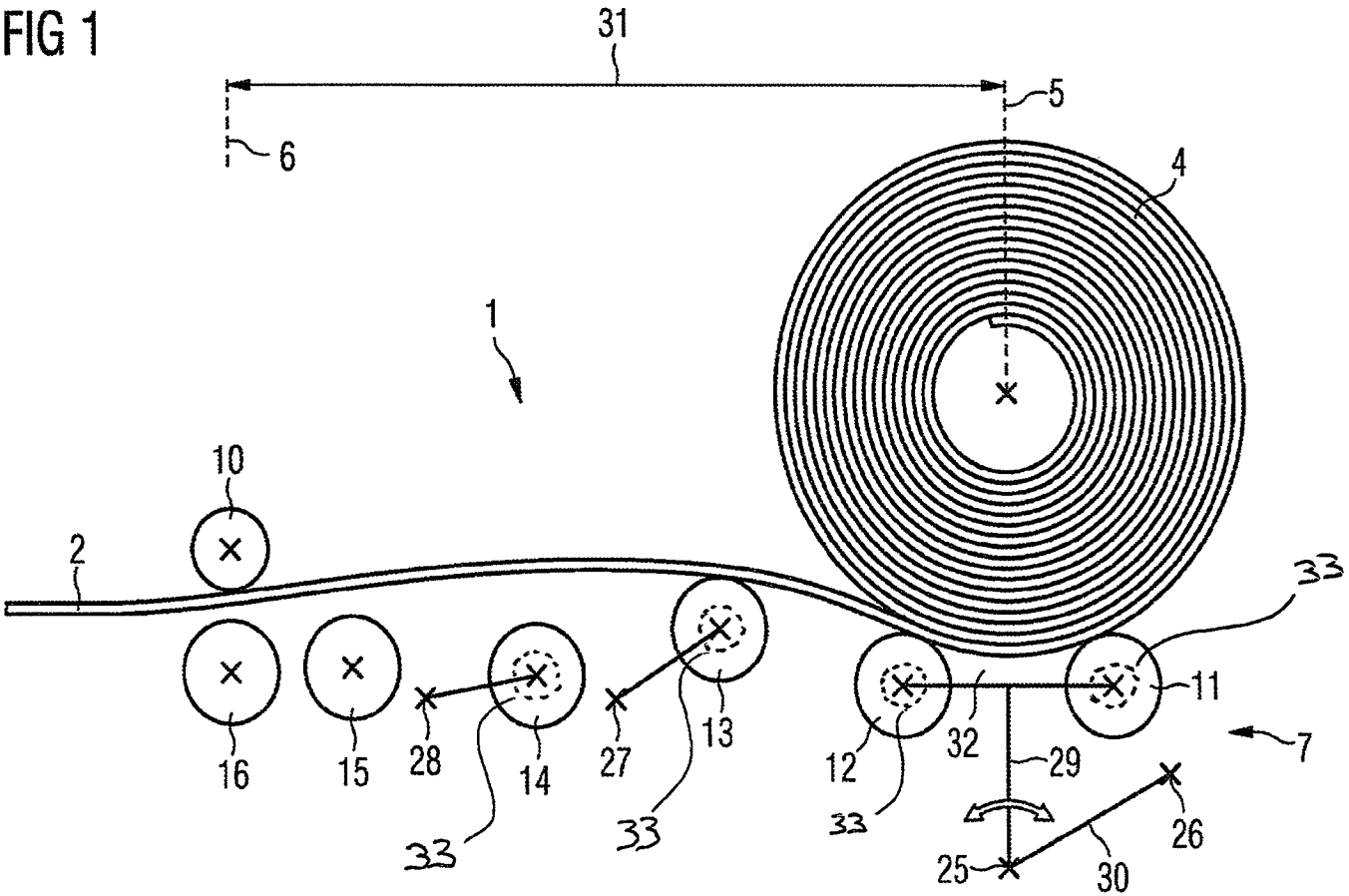
FIG. 1 shows a metal coil after winding into a winding position, where the unwinding process has already been started.
Figure 2:
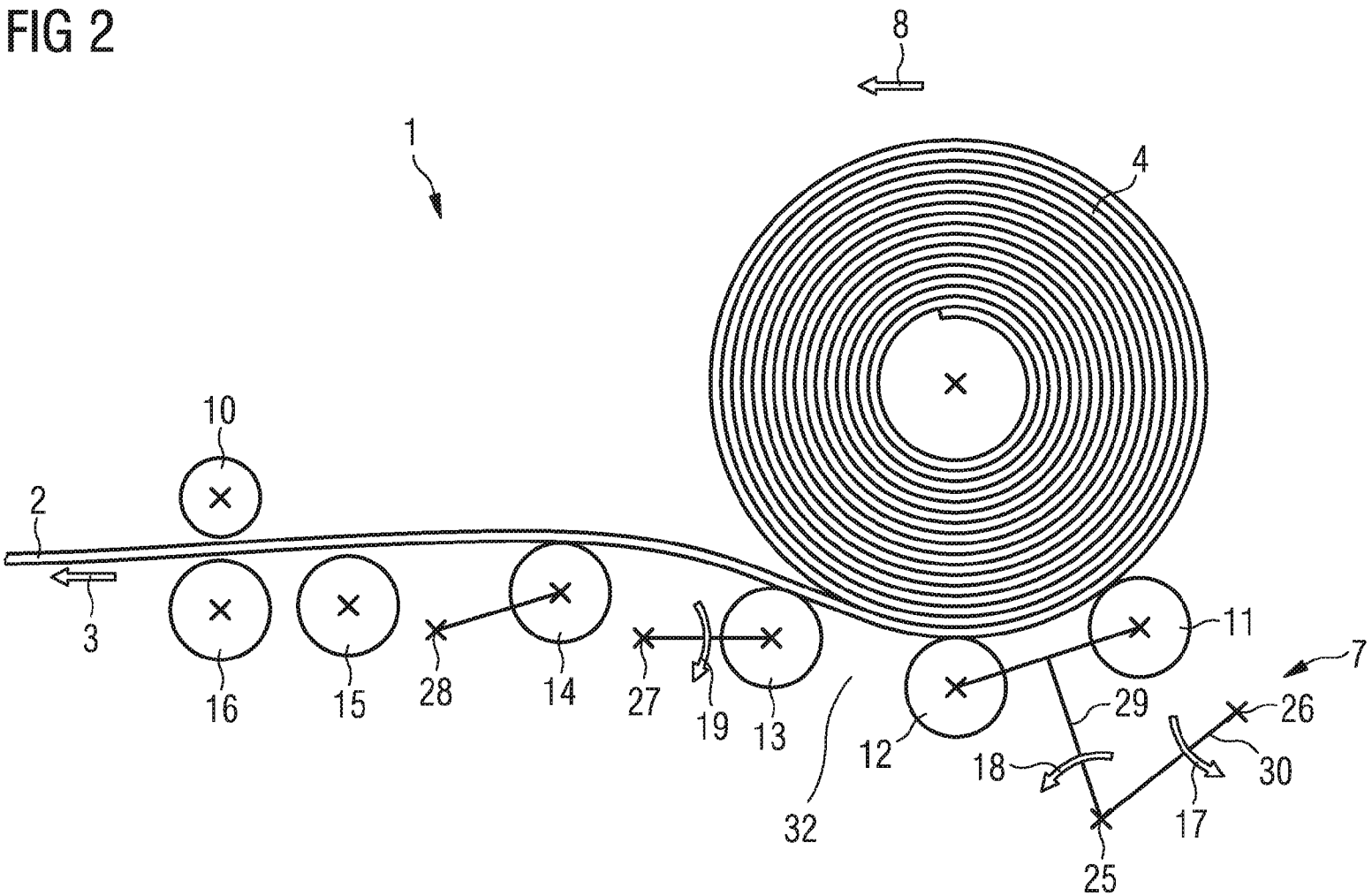
FIG. 2 shows a view of the configuration that is consecutive to FIG. 1, in which the metal coil has been moved from the winding position into an unwinding cradle formed by three support rollers.

FIG. 1 shows a metal coil 4 that is in a winding position 5 of a coil box that is not shown in more detail. Said coil box is disposed between a roughing train and a finishing train of a rolling mill. The coil box is used for reeling and unwinding the strip 2. The metal strip 2 arriving from the roughing train can usually have a temperature of around 900° C. to 1100° C.; the fully wound metal coil 4 usually weighs around 10 to 40 t. During the transfer on the transfer path 31, the metal coil 4 is continually unwound, the metal coil 4 rolling in each case with its outer winding supported on floor rollers or support rollers 11, 12, 13, 14, 15 disposed on the floor side. As can be seen from the sketch in FIG. 2, the support rollers 11, 12 are disposed on a common frame part 29. The support rollers 13 and 14 are each disposed on a swivel arm assigned thereto. The two swivel arms point towards the winding position 5. They are each pivotable by means of part-turn actuators, which are not shown, round a swivel axis 27 or 28. Each of the two support rollers 11, 12 disposed on the first frame part can be driven by an actuator unit 33 at the same rotational speed. Each of a first support roller 13 and a second support roller 14 disposed on a swivel arm can be rotationally driven by a respective actuator unit 33, wherein a rotational speed for each of the first and second support rollers 13, 14 is based on a velocity element derived from a pivoting movement of each of the first and second support rollers around a respective axis.

The view in FIG. 1 shows a configuration in which winding has already been completed. The end of the strip 2 of the metal coil 4 has already been unwound one segment. The strip head of the strip 2 has already been supplied to a driver or to a finishing train that is not shown in more detail.

As long as the metal coil 4 is in the winding position 5 shown in FIG. 1 a new rough strip cannot be wound in the coil box. The winding position in the coil box is occupied. Therefore, this winding position has to be vacated as quickly as possible.

As is demonstrated hereafter, the disclosed method creates a strategy for a careful transfer of the metal coil in the coil box.

The coil transfer is achieved according to the disclosed method by a coordinated adjustment of the axes of adjacent support rollers 11, 12, 13, 14, whereby a "wave trough" is created, continuing in the transfer direction 8 and forming an unwinding cradle 32 for the coil 4 that is unwinding.

This process of successive adjustment of adjacent support rollers is explained hereafter in more detail with the aid of a chronological sequence:

The sequence starts with a position of the metal coil 4, in which said coil rests on two support rollers 11 and 12 (FIG. 1). The two support rollers 11, 12 are mounted on a transverse member of a first frame part 29 and rotationally driven. The first frame part 29 includes a transverse member and a longitudinal member. The transverse member and the longitudinal member are rigidly connected to each other. As can easily be seen from FIG. 1, the transverse member and the longitudinal member form a "T" shape. The longitudinal member of the first frame part 29 is hinge-mounted at the end onto a second frame part 30. The first frame part 29 and the second frame part 30 together form the supporting frame 7. The supporting frame 7 functions as an angle lever: both the first frame part 29 and the second frame part 30 are each pivotable round an assigned swivel axis 25 or 26 (in FIG. 1 to FIG. 7 in the drawings the actuators have been omitted in order to give a better overview). Using driving force, the two rollers 11 and 12 can be moved in two degrees of freedom (vertically and horizontally). FIG. 1 shows a configuration in which the two support rollers 11, 12, by virtue of the distance between them, form a cradle that opens towards the top, in which cradle the metal coil 4 is received in a stable position.

In order to move the metal coil 4 out of said stable position into an unwinding position 6, the supporting frame 7 is tilted and simultaneously lowered. As can be seen from FIG. 2, this tilting and lowering movement is achieved by pivoting the first frame part 29 in the direction of the arrow 18 round the pivotal axis 25, and simultaneously the second frame part is lowered downwards in the direction of the arrow 17. Due to gravity and the incipient strip tension 3, the metal coil 4 starts to move in the transfer direction 8. The support roller 13 initially restricts this movement. The metal coil 4 now again rests in a stable manner in an unwinding cradle 32, which is one segment further to the left than in FIG. 1. The three rollers 11, 12 and 13 support the metal coil 4 in this position. The transfer into this position has been achieved gently and without any inadmissibly high exertion of force on the lateral surface of the coil 4.

Figure 3:
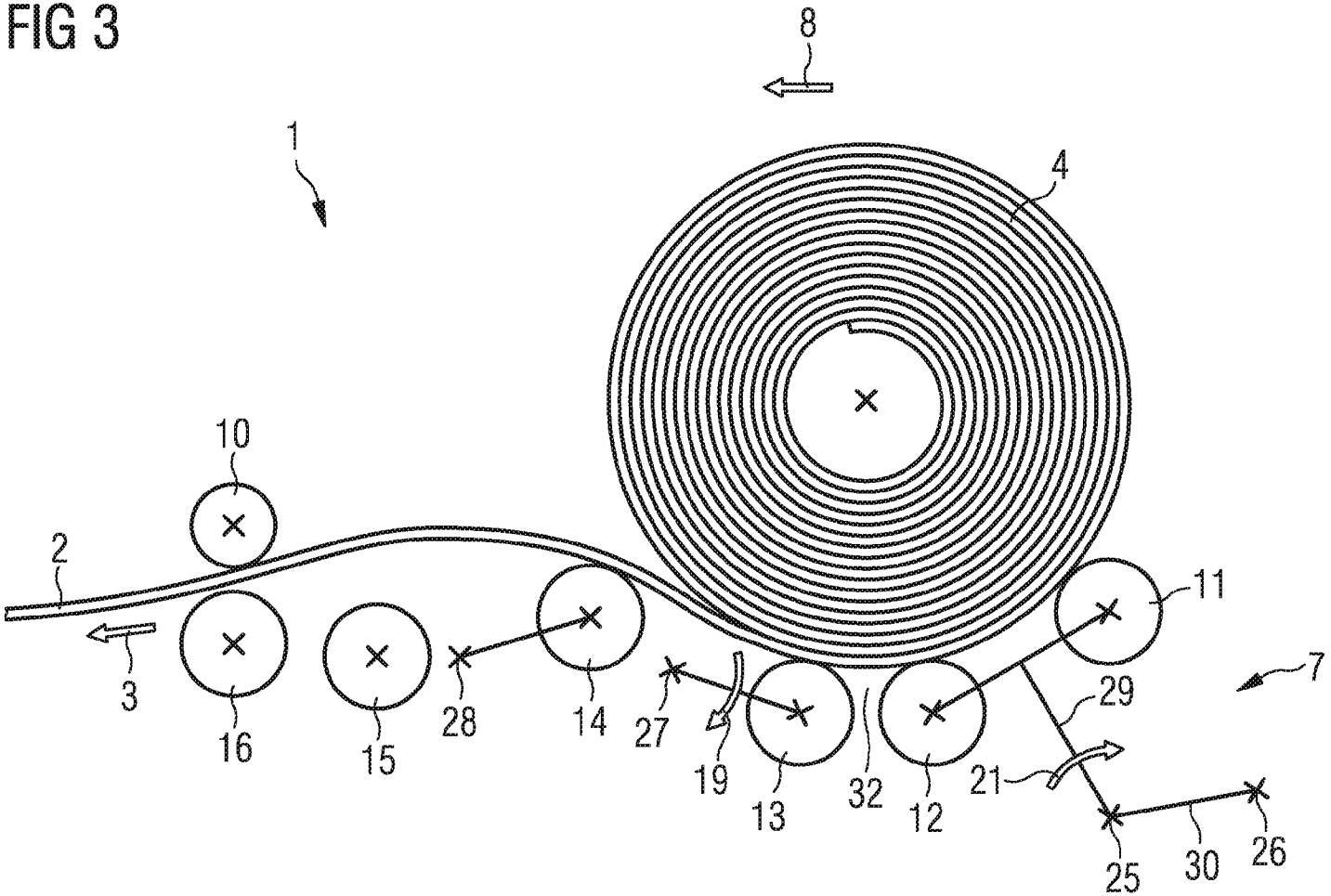
FIG. 3 shows a view of the configuration that is consecutive to FIG. 2, in which the metal coil has been further moved horizontally and is supported in the unwinding cradle by two adjacent support rollers.
Figure 4:
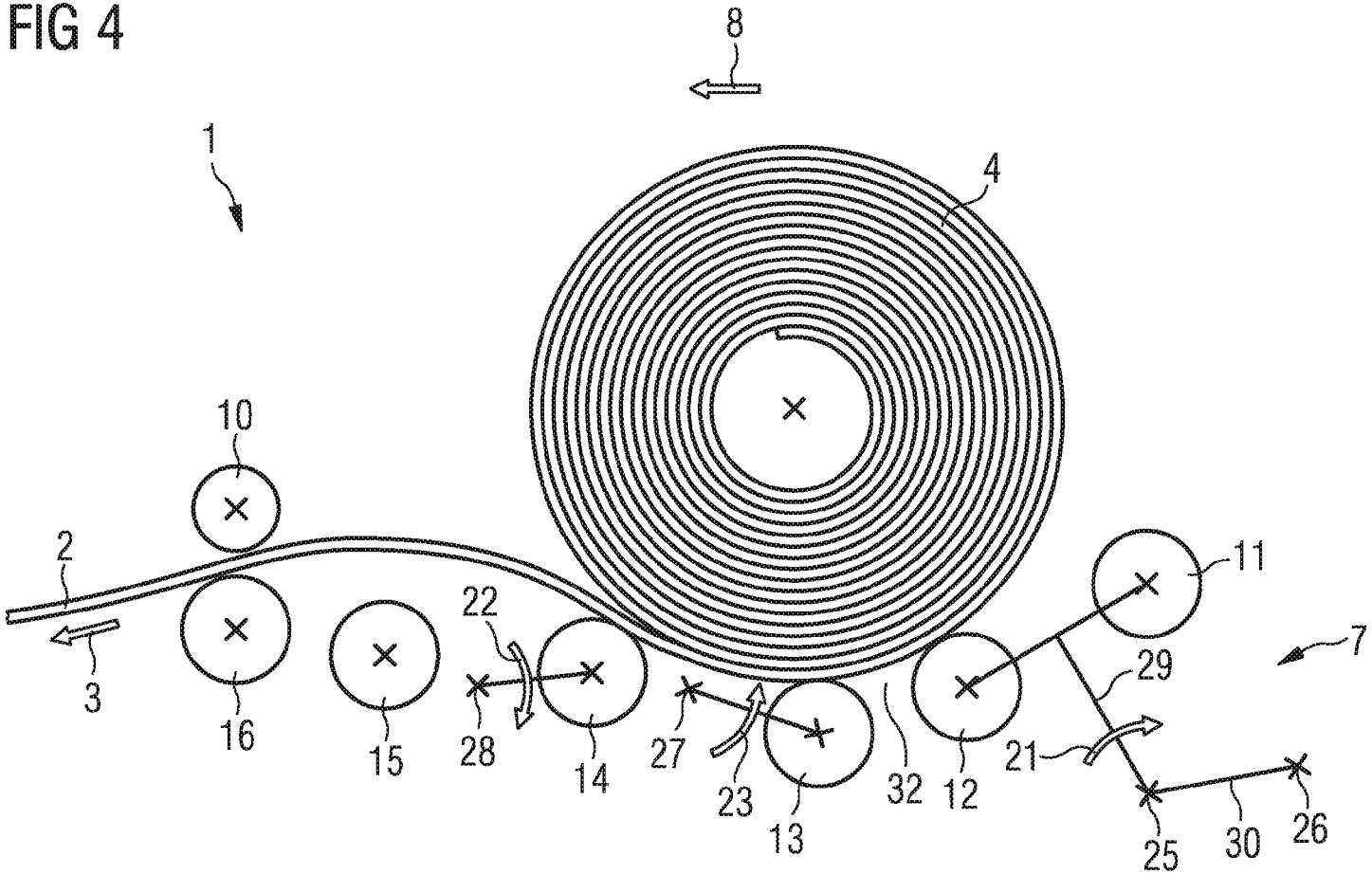
FIG. 4 shows a view of the configuration that is consecutive to FIG. 3, in which, after continuing along a segment in a horizontal direction, the metal coil now rests in an unwinding cradle on three support rollers.

For the further transfer, the first support roller 13 is now tilted downwards in the direction of the arrow 19 round the axis 27, as a result of which, due to gravity, the lateral movement of the metal coil 4 is again continued in FIG. 3 until the metal coil 4 gently comes to rest temporarily in the unwinding cradle 32 that has thus been created (FIG. 3). In this position there are now two support rollers again supporting the metal coil 4, that is, the first support roller 13 and the downstream support roller 12 of the supporting frame 7.

A further lowering of the first support roller 13 causes the metal coil 4 to continue its lateral movement in the direction of the unwinding position 6 once again. This is supported by a pivoting movement of the supporting frame 7 directed in a clockwise direction, the first frame part 29 being rotated round the axis 25 in the direction of the arrow 21. The unwinding cradle 32 has therefore moved further in the direction of the arrow 8, together with the metal coil 4 that is unrolling thereon. Now there are again three support rollers supporting the metal coil 4 (FIG. 4), that is, the downstream support roller 12 of the supporting frame 7 and the lowered first support roller 13 and the second support roller 14.

Figure 5:
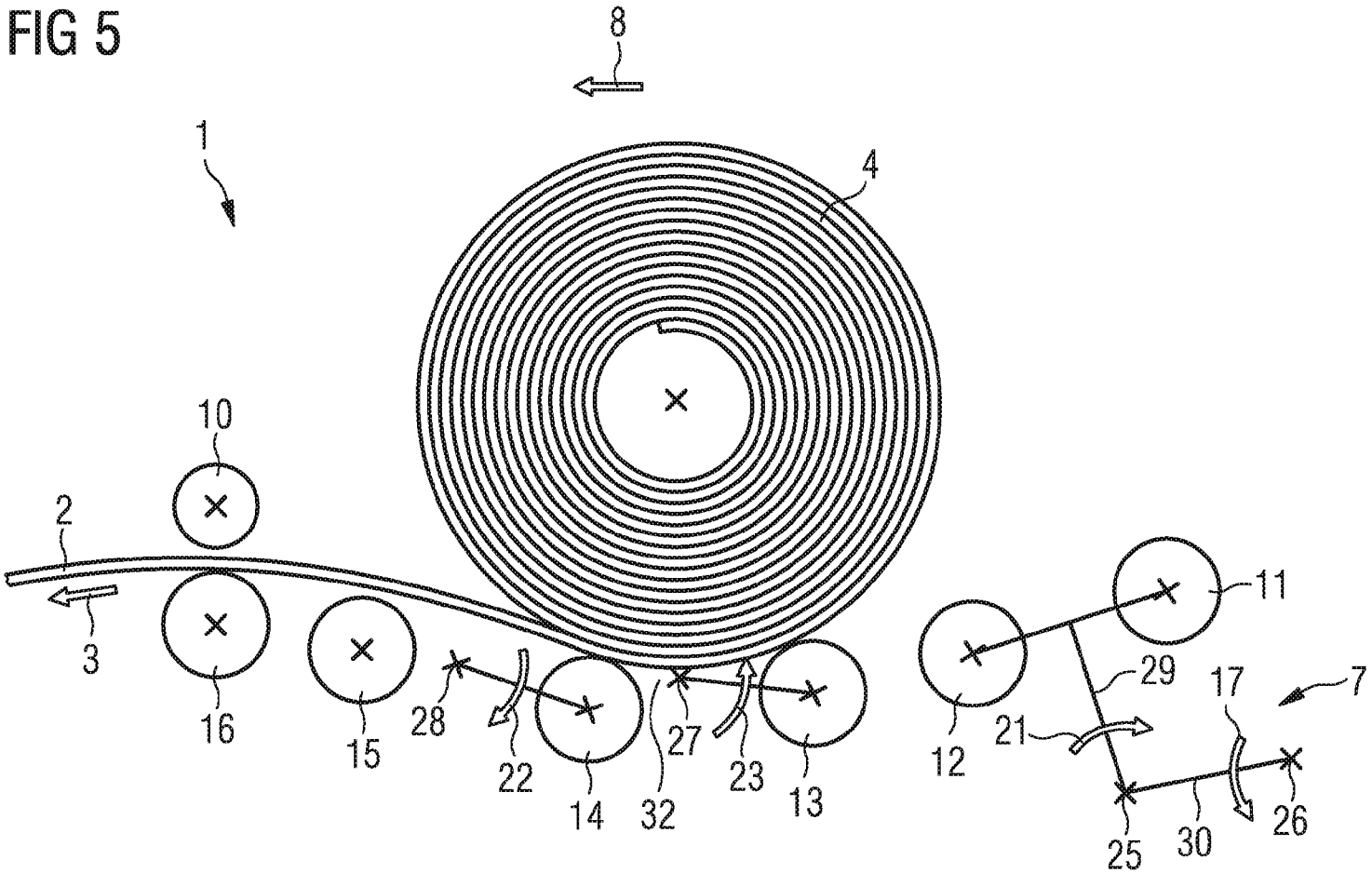
FIG. 5 shows a view of the configuration that is subsequent to the view shown in FIG. 4, which shows the metal coil in a position into which it has been transferred by simultaneous lifting and lowering of two adjacent support rollers and is now supported again by two support rollers.

FIG. 5 now shows a scenario according to a continuation of this principle. After lowering the second support roller 14 round the axis 28 according to the arrow 22, the metal coil 4 moves on into this recess. The lateral movement is supported by upward tilting of the first support roller 13 in the direction of the arrow 23. As a result, the unwinding cradle 32 has moved a segment further to the left in FIG. 5. The first support roller 13 and the second support roller 14 support the metal coil 4 in this configuration (FIG. 5). Here, too, the coil 4 is now resting in a stable position once again.

Figure 6:
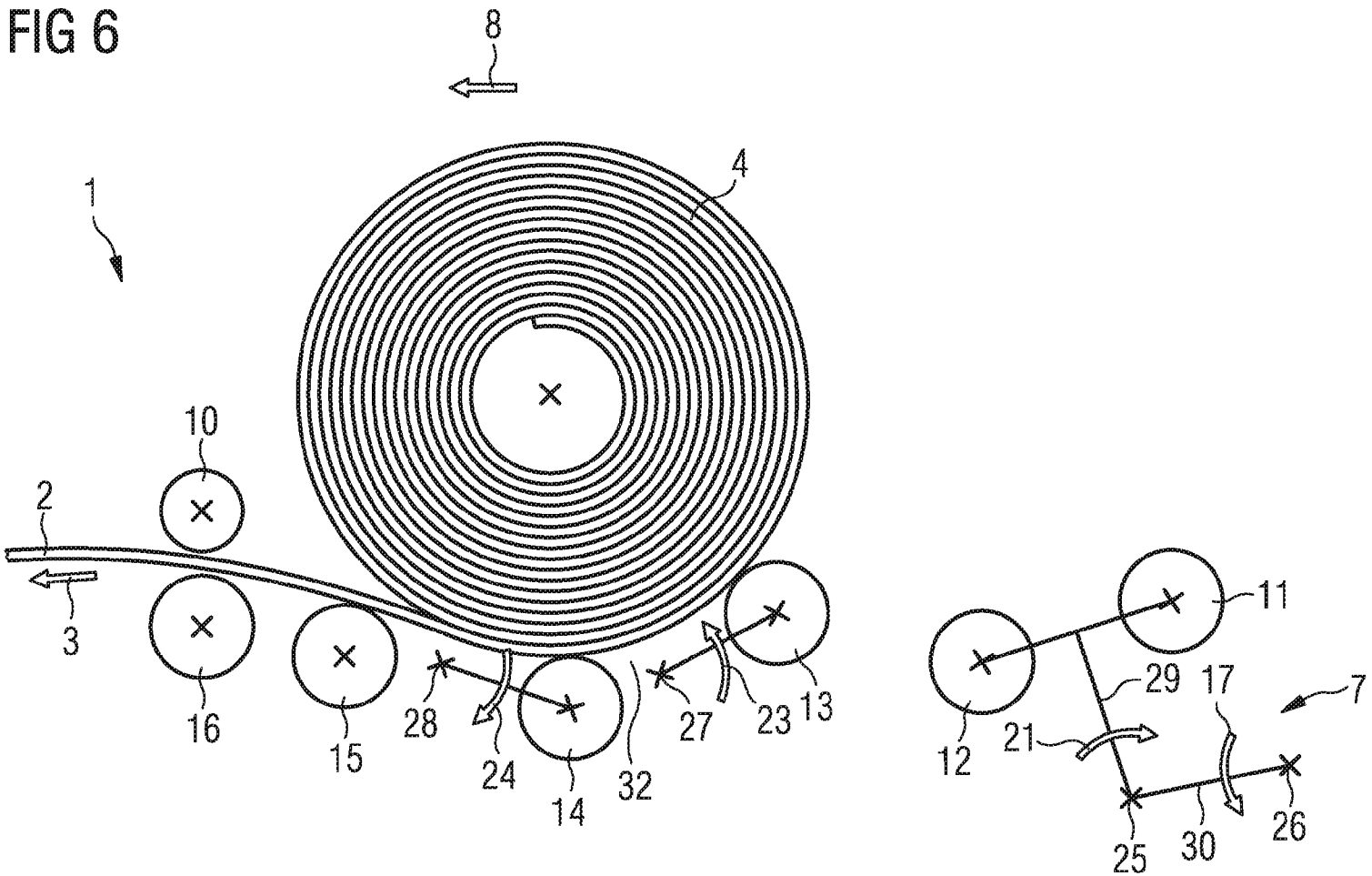
FIG. 6 shows a configuration that is subsequent to the scenario in FIG. 5, in which the support roller at the input end is raised such that the metal coil is again supported by three support rollers.
Figure 7:
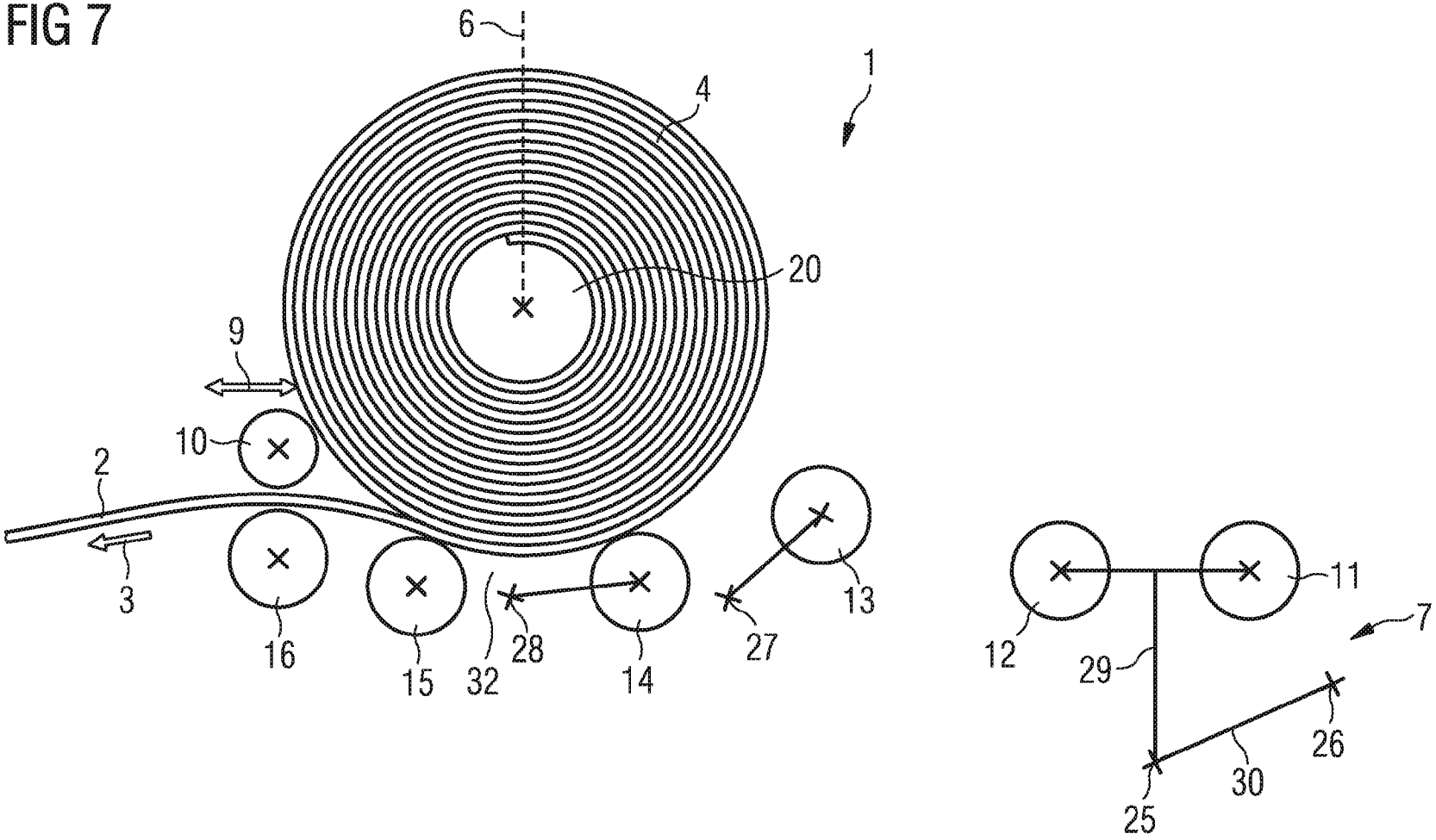
FIG. 7 shows a view at the end of the horizontal transfer process, in which the metal coil has been completely transferred to the unwinding position and in this position is again supported by two support rollers and can be restricted by a retaining roller from further rolling in a horizontal direction.

In order to move the metal coil 4 out of this position and further in the direction of the unwinding position 6, the "wave trough" is moved further to the left. As shown in FIG. 5, the second support roller 14 is tilted downwards according to the arrow 22 and the first support roller 13 is tilted upwards in the direction of the arrow 23. The metal coil 4 now rests temporarily again in a stable position on three support rollers, that is, the first support roller 13, the second support roller 14, and the fixedly mounted support roller 15 (FIG. 6).

Ultimately, in the final step, the first support roller 13 and the second support roller 14 are tilted upwards anti-clockwise, which results in the metal coil 4 being raised up. As soon as the second support roller 14 is at the height of the fixedly-mounted third support roller 15, the transfer of the metal coil 4 has been completed. The metal coil 4 is now located in the unwinding position 6. In this final movement segment, a roller 10 functions as a retaining roller or support roller and prevents the metal coil 4 from rolling too far in the direction of the driver due to the rigid arrangement of the support roller 15. In order for this final transfer step to be intercepted as gently as possible, the supporting or retaining roller 10 is positionally adjustable in a horizontal direction along the double arrow 9. By means of the adjusted roller 10, which unrolls along the perimeter of the coil 4, it is possible for the unwinding coil to be equipped with studs towards the end of the strip in order to prevent the final coil layers from being squeezed together. The fact that the roller 10 can be moved horizontally allows the eye of the strip 20 to be positioned before a stud moves into place.

The principle of the movement of an advancing floor recess may have the advantage that the metal coil is continually resting in a cradle, that is, in a stable position. The transfer of the metal coil 4 from support roller to support roller is able to ensue comparatively gently due to a corresponding adjustment of the support rollers.

As already mentioned, each of the rollers 11, 12, 13, 14 is rotatably driven, the peripheral speed being set such that there is no slippage between the speed of the strip 2 and the rotational movement of the roller. In order to come as close as possible to this objective, the linear velocity element resulting from the pivoting movement of the roller is taken into account when setting the rotational speed of the roller.

LIST OF REFERENCE SIGNS USED

1 coil transfer device
2 strip
3 strip tension
4 coil
5 first coil position (winding position)
6 second coil position (unwinding position)
7 supporting frame
8 transfer device
9 double arrow
10 support roller (retaining roller)
11 first support roller
12 second support roller
13 third support roller
14 fourth support roller
15 fifth support roller
16 downstream roller
17 pivoting movement downwards of the second frame part 30
18 pivoting movement of the first frame part 29 in direction 8
19 pivoting movement downwards of the support roller 13
20 eye of the coil
21 pivoting movement of the first frame part 29 towards the direction 8
22 pivoting movement downwards of the support roller 14
23 pivoting movement upwards of the support roller 13
24 pivoting movement upwards of the support roller 14
25 swivel axis of the first frame part 29
26 swivel axis of the second frame part 30
27 swivel axis of the third support roller 13
28 swivel axis of the fourth support roller 14
29 first frame part
30 second frame part
31 transfer path, distance between the first and the second coil position
32 unwinding cradle
33 actuator unit

What is claimed is:

1. A method for transferring a metal coil on a transfer path between a first coil position and a second coil position, comprising:

supporting the metal coil during the transfer on the transfer path in segments using a plurality of support rollers, and simultaneously unwinding the metal coil forming an unwinding cradle expanding in a direction of the transfer path by changing positions of one or more support rollers disposed adjacent to each other;

wherein the metal coil is supported by two support rollers disposed on a first frame part in the first coil position and is moved in a direction of the second coil position from said first coil position while said frame part is simultaneously tilted and lowered.

2. The method of claim 1, comprising pivoting the first frame part on a second frame part, wherein the tilting and lowering movement is generated by a pivoting movement of the first frame part around an axis and a simultaneous pivoting movement of the second frame part around a different axis.

3. The method of claim 1, wherein the metal coil is supported during the transfer in an alternating sequence by two or by three support rollers.

4. The method of claim 3, wherein each of the two support rollers disposed on the first frame part are driven by an actuator unit at the same rotational speed.

5. The method of claim 1, wherein each of a first support roller and a second support roller is disposed on a swivel arm and rotationally driven by a respective actuator unit, the method comprising setting a rotational speed for each of the first and second support rollers based on a velocity element derived from a pivoting movement of each of the first and second support rollers around a respective axis.

6. The method of claim 1, wherein the metal coil is supported in the unwinding position by means of an adjustable support roller.

7. A system for transferring a metal coil on a transfer path between a first coil position and a second coil position, comprising:

a plurality of support rollers configured to support the metal coil during the transfer of the metal coil on the transfer path in segments using the plurality of support rollers, during simultaneous unwinding the metal coil, an unwinding cradle expanding in a direction of the transfer path, the unwinding cradle formed by changing positions of one or more support rollers disposed adjacent to each other, a first frame part supporting two support rollers for supporting the metal coil in the first coil position, the first frame part configured to be simultaneously tilted and lowered for moving the metal coil from the first coil position toward the second coil position.

8. The system of claim 7, wherein the first frame part is configured to be pivoted on a second frame part, wherein the first frame part is configured to pivot around a first axis during a simultaneous pivoting of the second frame part around a second axis, the pivoting of the first frame part around the first axis providing the simultaneous tilting and lowering of the first frame part.

9. The system of claim 7, wherein the metal coil is supported during the transfer in an alternating sequence by two or by three support rollers.

10. The system of claim 9, comprising respective actuator units configured to drive the two support rollers at the same rotational speed.

11. The system of claim 7, comprising a swivel arm supporting a first support roller and a second support roller, each of first and second support rollers being rotationally driven by a respective actuator unit, and a controller configured to set a rotational speed for each of the first and second support rollers based on a velocity element derived from a pivoting movement of each of the first and second support rollers around a respective axis.

12. The system of claim 7, comprising an adjustable support roller configured to support the metal coil in the unwinding position.

* * * * *